US006091040A

United States Patent [19]

Mascher

[11] Patent Number: 6,091,040

[45] Date of Patent: Jul. 18, 2000

[54] OUTDOOR HIGH-VOLTAGE POWER CIRCUIT BREAKER

[75] Inventor: Karl Mascher, Berlin, Germany

[73] Assignee: Siemens AG, Munich, Germany

[21] Appl. No.: 09/101,151

[22] PCT Filed: Dec. 20, 1996

[86] PCT No.: PCT/DE96/02482

§ 371 Date: Apr. 7, 1999

§ 102(e) Date: Apr. 7, 1999

[87] PCT Pub. No.: WO97/25732

PCT Pub. Date: Jul. 17, 1997

[30] Foreign Application Priority Data

Jan. 5, 1996 [DE] Germany ..... 196 01 053

[51] Int. Cl.[7] ..... H01H 33/16

[52] U.S. Cl. ..... 218/155; 218/144; 218/145

[58] Field of Search ..... 218/1, 2, 4–6, 218/8, 11, 143–145, 155

[56] References Cited

U.S. PATENT DOCUMENTS

| | | | |
|---|---|---|---|
| 3,927,350 | 12/1975 | McConnell | 317/11 C |
| 4,027,125 | 5/1977 | Peek et al. | 200/148 R |
| 4,434,333 | 2/1984 | Kawasaki | 200/144 AP |
| 5,039,831 | 8/1991 | Sato et al. | 200/144 AP |
| 5,604,340 | 2/1997 | Yamada et al. | 218/144 |
| 5,661,282 | 8/1997 | Tsuchiya et al. | 218/145 |

FOREIGN PATENT DOCUMENTS

| | | | |
|---|---|---|---|
| 0 482 555 | 4/1992 | European Pat. Off. | H01H 133/16 |
| 1 133 079 | 3/1957 | France . | |
| 1 170 411 | 1/1959 | France . | |
| 2 267 625 | 11/1975 | France | H01H 33/42 |
| 2 267 626 | 11/1975 | France | H01H 33/82 |
| 2 598 554 | 11/1987 | France | H01H 33/53 |
| 1 198 901 | 8/1965 | Germany . | |
| 1 995 069 | 10/1968 | Germany . | |
| 44 35 359 | 3/1996 | Germany . | |
| 275 593 | 8/1951 | Switzerland . | |
| 95/22158 | 8/1995 | WIPO | H01H 33/42 |

OTHER PUBLICATIONS

Siemens — Betriebsanleitung, "Leistungsschalter 3AS2", No Date.

*Primary Examiner*—Michael Friedhofer
*Attorney, Agent, or Firm*—Kenyon & Kenyon

[57] ABSTRACT

The invention concerns an open air high-voltage circuit breaker comprising a circuit breaker unit (13) and a control capacitor connected electrically in parallel to it and surrounded by a common composite isolation housing (7, 8) made essentially of plastic, resting a terminal column (1) fixed to one of its ends. The use of a composite isolation housing saves cost and weight at the upper end of the terminal column and also improves earthquake security.

4 Claims, 1 Drawing Sheet

OUTDOOR HIGH-VOLTAGE POWER CIRCUIT BREAKER

FIELD OF THE INVENTION

The present invention relates to an outdoor high-voltage power circuit breaker with an interrupter unit and a grading capacitor connected electrically in parallel with it.

BACKGROUND INFORMATION

A conventional outdoor h.v. power circuit breaker is described in German Utility Model No. 1 995 069, for example.

In the conventional outdoor power circuit breaker, both the interrupter unit and the grading capacitor are mounted on the upper end of a pole column. The longitudinal axes of the interrupter unit and the grading capacitor are horizontal. The interrupter unit and the grading capacitor are each arranged in a separate porcelain housing.

French Patent No. 1 170 411 describes a high-voltage power circuit-breaker including an insulator housing made of plastic in which a grading capacitor is arranged. The grading capacitor can be partially integrated into the wall of the plastic housing.

SUMMARY OF THE INVENTION

An object of the present invention is to make it simpler and less expensive to manufacture a h.v. power circuit breaker.

This object is achieved according to the present invention by providing a circuit breaker in which the interrupter unit and the grading capacitor are surrounded by a common composite insulator housing made essentially of plastic attached at one of its ends to a supporting pole column.

This design eliminates the need for a separate housing for the grading capacitor. The composite insulator housing is designed to be larger accordingly, so that it can accommodate both the interrupter unit and the grading capacitor. This arrangement nevertheless takes up less space than one with two individual insulator housings. Furthermore, assembly is simplified, because only a single housing need be attached to the end of the pole column. There is also only a single gas space in which both the interrupter unit and the grading capacitor are arranged. This is important in particular when the gas space is filled with a quenching gas such as $SF_6$ which must be monitored in some form.

A composite insulator housing can be manufactured with a much lower weight than a corresponding porcelain insulator. In comparison with the design with individual porcelain housings, two thirds of the weight is eliminated with a common composite insulator housing.

In accordance with an exemplary embodiment of the present invention, the composite insulator housing is partially relieved of the weight of the interrupter unit and the grading capacitor because one end of the interrupter unit, and the grading capacitor and resistor, are supported by part of a pole column, and, in particular, by a corner gear casing. These components can thus be mounted on the corner gear casing on a flange. The composite insulator housing may also be removed separately without having to also remove from the pole column the grading capacitor and the part of the interrupter unit mounted on the pole column.

An advantageous embodiment of the present invention provides a circuit breaker in which the interrupter unit and the grading capacitor are arranged side by side in parallel with one another.

This permits an especially space-saving arrangement of the interrupter unit and the grading capacitor.

Furthermore, the present invention can be designed to advantage by also arranging in the composite insulator housing a resistor wired in parallel electrically to the interrupter unit.

A closing resistor or tripping resistor or a voltage limiting element can also be accommodated in the composite insulator housing without requiring any extra space.

Another advantageous embodiment of the preset invention provides a circuit breaker in which one end of the interrupter unit and the grading capacitor, and the resistor be supported by part of the pole column, in particular by a corner gear casing.

This design relieves the composite insulator housing of some of the weight of the interrupter unit, the grading capacitor, and the closing resistor. These components can thus be mounted on the corner gear casing, namely on a flange. The composite insulator housing can also be removed separately from the pole column without removing the part of the interrupter unit and the grading capacitor mounted on the pole column.

Another advantageous embodiment of the present invention provides a circuit breaker in which the composite insulator housing is a fiber-reinforced plastic tube with silicone shields arranged on the outside.

A high mechanical stability of the composite insulator housing is achieved by using a fiber-reinforced plastic tube. The silicone shields arranged on the outside ensure a high dielectric strength on the outside and prevent creep currents.

Another advantageous embodiment of the invention proposes that the composite insulator housing be lined with a layer of plastic on the inside.

Due to the internal lining of the composite insulator housing with a fiber-reinforced plastic, for example, such as that available under the brand name Trevira, the inside wall of the plastic tube is protected from the influence of switching gases which can develop due to the electric arc burning in the interrupter unit.

DETAILED DESCRIPTION

Figure 1:
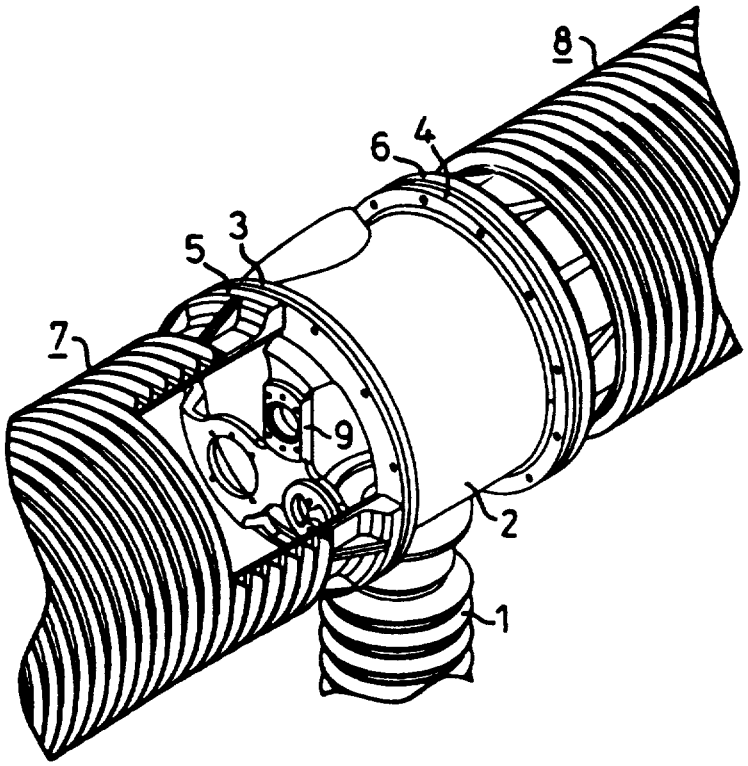
FIG. 1 shows a perspective top view of the composite insulator housing in accordance with an exemplary embodiment of the present invention.

FIG. 1 shows upper section 1 of a pole column arranged in a vertical orientation on a mounting structure (not shown). On upper section 1 of the pole column there is mounted a corner gear casing 2 in which the pulling and pushing movements of a drive rod running in the pole column are translated into the horizontal direction in switching. The corner gear is not shown in detail in the figure.

In the exemplary embodiment illustrated here, the pole column supports two interrupter units.

Corner gear casing 2 has a flange 3, 4 on each side to which a mounting flange 5, 6 of a composite insulator housing 7, 8 is attached by bolts. Only part of composite insulator housing 7, 8 is shown on each side of corner gear casing 2.

Supporting base 9 for the interrupter unit (not shown here), the grading capacitor and the closing resistor can be seen through a cutaway portion of composite insulator housing 7. Supporting base 9 is connected to and supported by corner gear casing 2.

Figure 2:
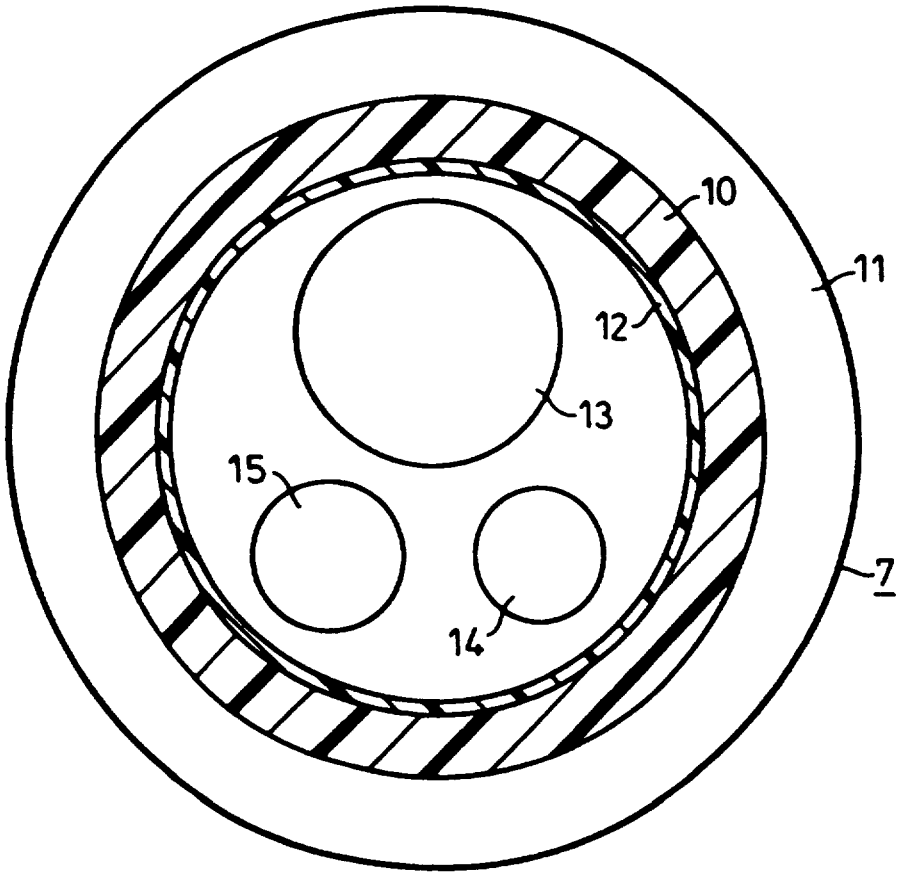
FIG. 2 shows a schematic cross-sectional view of the interrupter unit, the grading capacitor and the closing resistor with the composite insulator housing in accordance with an exemplary embodiment of the present invention.

FIG. 2 shows in schematic form a cross section through composite insulator housing 7 with a tube 10 made of fiberglass-reinforced plastic and with silicone shields 11 arranged on it on the outside and an internal lining 12. An interrupter unit 13, a closing resistor 14 arranged in parallel next to it and a grading capacitor 15 are shown in the interior of composite insulator housing 7.

I claim:

1. An outdoor high-voltage power circuit breaker, comprising:

a pole column including a corner gear casing and having a first longitudinal axis;

a composite insulator housing mounted on the pole column and having a second longitudinal axis, the second longitudinal axis being across the first longitudinal axis, the composite insulator housing being substantially composed of plastic;

an interrupter unit; and a grading capacitor electrically coupled in parallel to the interrupter unit, the grading capacitor being arranged adjacent and parallel to the interrupter unit, the interrupter unit and the grading capacitor being surrounded by the composite insulator housing and being supported at a first end by the corner gear casing.

2. The outdoor high-voltage power circuit breaker according to claim 1, further comprising:

a resistor electrically coupled in parallel to the interrupter unit and arranged in the composite insulator housing.

3. The outdoor high-voltage power circuit breaker according to claim 1, wherein the composite insulator housing includes a fiber-reinforced plastic tube and a silicon shield, the silicon shield being arranged on an outside surface of the tube.

4. The outdoor circuit breaker according to claim 1, wherein the composite insulator housing includes a plastic layer, the plastic layer being arranged on an inside surface of the composite insulator housing.

* * * * *